United States Patent [19]

Simmons

[11] 4,253,935

[45] Mar. 3, 1981

[54] METHOD OF PREPARING A DIAPHRAGM HAVING A GEL OF A HYDROUS OXIDE OR ZIRCONIUM IN A POROUS MATRIX

[75] Inventor: Robert B. Simmons, Norton, Ohio

[73] Assignee: PPG Industries, Inc., Pittsburgh, Pa.

[21] Appl. No.: 76,897

[22] Filed: Sep. 19, 1979

Related U.S. Application Data

[63] Continuation-in-part of Ser. No. 953,132, Oct. 20, 1978, Pat. No. 4,170,538, and Ser. No. 953,133, Oct. 20, 1978, and Ser. No. 953,134, Oct. 20, 1978.

[51] Int. Cl.[3] ..... C25B 13/00; C25B 13/08

[52] U.S. Cl. ..... 204/295; 204/128; 204/252; 204/296

[58] Field of Search ..... 204/295, 296, 28, 98, 204/128, 252, 301; 92/21

[56] References Cited

U.S. PATENT DOCUMENTS

| | | | |
|---|---|---|---|
| 1,942,183 | 1/1934 | Muller | 204/28 |
| 2,661,288 | 12/1953 | Barbaras | 92/21 |
| 3,056,647 | 10/1962 | Amphlett | 23/14.5 |
| 3,479,267 | 11/1969 | Rajan et al. | 204/295 X |
| 3,702,267 | 11/1972 | Grot | 204/295 X |
| 3,703,413 | 11/1972 | Arrance | 136/6 |
| 4,089,758 | 5/1978 | McAloon | 204/98 |

*Primary Examiner*—Arthur C. Prescott

*Attorney, Agent, or Firm*—Richard M. Goldman

[57] ABSTRACT

Disclosed is a method of vacuum depositing zirconia and magnesia in a porous matrix to form a diaphragm.

16 Claims, No Drawings

METHOD OF PREPARING A DIAPHRAGM HAVING A GEL OF A HYDROUS OXIDE OR ZIRCONIUM IN A POROUS MATRIX

CROSS REFERENCE TO RELATED APPLICATIONS

This is a continuation-in-part of my commonly-assigned copending U.S. applications Ser. No. 953,132, filed Oct. 20, 1978 now U.S. Pat. No. 4,170,538 for DIAPHRAGM HAVING ZIRCONIUM AND MAGNESIUM COMPOUNDS IN A POROUS MATRIX, Ser. No. 953,133, filed Oct. 20, 1978, for DIAPHRAGM HAVING ZIRCONIUM OXIDE AND A HYDROPHILIC FLUOROCARBON RESIN AND A HYDROPHOBIC MATRIX, and Ser. No. 953,134, filed Oct. 20, 1978, for METHOD OF PREPARING A DIAPHRAGM HAVING A GEL OF A HYDROUS OXIDE OF ZIRCONIUM IN A POROUS MATRIX.

Alkali metal chloride brines, such as potassium chloride brines and sodium chloride brines, may be electrolyzed in a diaphragm cell to yield chlorine, hydrogen, and aqueous alkali metal hydroxide. In a diaphragm cell, brine is fed to the anolyte compartment and chlorine is evolved at the anode. Electrolyte from the anolyte compartment percolates through an electrolyte permeable diaphragm to the catholyte compartment where hydroxyl ions and hydrogen gas are evolved.

Previously, the diaphragm has been provided by fibrous asbestos deposited on an electrolyte permeable cathode. However, environmental and economic considerations now dictate a more longer-lived, less environmentally threatening diaphragm. It is, therefore, necessary to provide either a synthetic polymer diaphragm, a porous ceramic diaphragm, a non-asbestos inorganic fiber matrix, or a modified asbestos diaphragm between the anolyte compartment and the catholyte compartment of the cell.

One particularly satisfactory diaphragm is a diaphragm having a porous matrix, e.g., a polymeric, ceramic, or asbestos matrix, with a hydrous oxide of zirconium contained within the matrix. As herein contemplated the diaphragm may be prepared by contacting and preferably saturating a porous matrix with a zirconium compound, whereby to preferably fill the porous matrix with the zirconium compound, converting the zirconium compound to an oxide, for example, by hydrolysis, and thereafter removing the by-products of the hydrolysis.

More particularly, there is contemplated a method of preparing a diaphragm having a contained volume surface of a hydrous oxide of zirconium by vacuum depositing zirconyl chloride solution in a porous matrix, hydrolyzing the zirconyl chloride with ammonia to the hydrous oxide of zirconium, and leaching out the ammonium chloride formed thereby. A fast, one cycle deposition is obtained thereby.

DETAILED DESCRIPTION OF THE INVENTION

The diaphragm prepared by the method of this invention is characterized by a porous matrix with a volume of a hydrous oxide of zirconium contained in the matrix void volume. The matrix is substantially inert to the electrolyte. Suitable materials of construction include asbestos fibers, and halocarbon polymers, and ceramics, e.g., ceramic fibers, ceramic particles and cast porous ceramics. The fluorocarbon polymers useful in providing the substrate are fluorocarbons and chlorofluorocarbons, e.g., perfluorinated polymers such as polyperfluoroethylene, polyperfluoroethylene, polyperfluoroalkoxys, and polyperfluoroethylene-propylene, fluorinated polymers such as polyvinylidene fluoride and polyvinyl fluoride and chlorofluorocarbon polymers such as chlorotrifluoroethylene and the like. Alternatively, chlorocarbons as polyvinyl chloride, polyvinylidene chloride and copolymers thereof may be used. Especially preferred are the perfluorinated polymers. As used herein, the term fluorocarbon polymers also encompasses those fluorocarbon polymers having active groups thereon, e.g., fluorocarbon polymers having sulfonic acid groups, sulfonamide groups, and carboxylic acid groups, inter alia. Additionally, the fluorocarbon polymer may have a coating, layer, or film of a fluorocarbon resin having pendant active sites thereon. The film may be provided by treating the matrix with a suitable perfluorinated resin having pendant sulfonic acid groups, pendant sulfonamie groups, pendant carboxylic acid groups, or derivatives thereof.

The matrix may be fibrous, e.g., either woven fibers or non-woven fibers such as felts. The felts may be formed by deposition, for example, by filtration type processes, or by needle punch felting processes. Alternatively, the porous matrix may be in the form of a sheet or film. The sheet or film may be rendered porous as described, for example, in British Pat. No. 1,355,373 to W. L. Gore and Associates for *POROUS MATERIALS DERIVED FROM TETRAFLUOROETHYLENE AND PROCESS FOR THEIR PRODUCTION,* or as exemplified by Glasrock "Porex" brand polytetrafluoroethylene films.

The porous sheet or film should have a thickness of from about 10 to about 50 mils with pores of from about 0.8 to about 50 micrometers in diameter and preferably from about 2 to about 25 micrometers in diameter The porosity of the porous sheet or film should be from about 30 to about 90 percent.

The thickness of the porous felt should be from about 0.04 to about 0.2 inch and preferably about 0.05 to 0.15 inch. The porosity of the porous felt should be from about 30 to about 90 percent.

The substrate surface has a film or layer of a hydrous oxide of zirconia, i.e., a gel of zirconia. The zirconia gel is believed to have the chemical formula $ZrO_2 \, x \, nH_2O$ and is characterized as a hydrous zirconia gel. "n" is generally from about 2 to about 4. Low loadings of zirconia alone, e.g., below about 0.1 gram per cubic centimeter, result in a diaphragm that is high in permeability and low in current efficiency. Intermediate loadings of zirconia alone, that is, from about 0.1 to about 1.0 gram per cubic centimeter, provide a diaphragm that is high in permeability and of improved current efficiency. Diaphragms that are high in zirconia alone, e.g., above about 1.0 gram per cubic centimeter, have a permeability that is too low. Preferably, the loading of zirconia is from about 0.1 to about 1.0 gram per cubic centimeter for a mat having a porosity of about 0.70 to about 0.90.

According to a particularly preferred exemplification, the internal void volume of the matrix herein contemplated contains hydrous oxides of both zirconia and magnesia, that is, gels of zirconia and magnesia. The zirconia gel has the chemical formula $ZrO_2 \, x \, nH_2O$ and the magnesia gel has the chemical formula $MgO \, x \, mH_2O$, where n and m are generally from about 1 to about 8, although substantial excesses of water may be present.

At loadings of zirconia gel between about 0.1 to about 1.0 gram per cubic centimeter calculated as $ZrO_2$, the presence of MgO in the matrix decreases the permeability of the diaphragm while allowing increased current efficiency.

Magnesia may be an anolyte addition but is preferably incorporated with the zirconium oxychloride in the formation of the hydrous oxide of zirconium. The magnesia is believed to be present in the gel in the form of a hydrated oxide of magnesium having the formula $MgO\ x\ mH_2O$ where m is generally from 2 to 10 although substantial excesses of water may be present.

While the exact role of the magnesia is not clearly understood, it is believed to control permeability, that is, to reduce permeability, i.e., to increase the diaphragm's resistance to fluid flow, without deleteriously affecting current efficiency, while the zirconia modifies the porosity, contains the magnesia in the matrix and enhances wettability. The loading of magnesia is from about $5\times10^{-3}$ gram per cubic centimeter to about $1.5\times10^{-1}$ gram per cubic centimeter.

In this way, the zirconia to total zirconia and magnesia ratio in the diaphragm is from about 0.30 to about 0.995. Preferably the weight ratio of zirconia to total zirconia and magnesia is from about 0.70 to about 0.995 with a ratio of from about 0.85 to about 0.98 being particularly preferred.

The magnesia and zirconia diaphragm component is believed to be a gel of the hydrated oxides of the zirconium and magnesium where the weight ratio of zirconia to total zirconia and magnesia is from about 0.7 to about 0.995 and preferably from about 0.85 to about 0.98.

In an exemplification of this invention where a felt matrix is utilized, the matrix may be treated with a compatible perfluorinated hydrocarbon polymer having pendant, wettability enhancing groups such as acid groups or alkaline groups, for example, sulfonic acid groups, carboxylic acid groups, sulfonamide groups, or the like. This may be accomplished by providing a solution of the fluorocarbon resin in alcohol, water, or a miscible system of alcohol and water, and thereafter evaporating off the solvent. Thereafter, the gel is formed within the matrix, that is, on the external and internal surfaces of the matrix.

The presence of surface active or wettability enhancing moieties in admixture with the zirconia or zirconia and magnesia on the surface of the diaphragm produces a wettable diaphragm, especially where the matrix has pores of from about 5 to about 15 micrometers in diameter. The hydrophilic fluorocarbon resin is applied to the matrix first and thereafter the zirconia is formed or the zirconia and magnesia are formed in the matrix.

The hydrophilic resin, i.e., a perfluorinated hydrocarbon, having pendant wettability enhancing groups such as acid groups or basic groups is provided on the surfaces of the hydrophobic perfluorocarbon substrate in order to enhance the wettability of the diaphragm.

The fluorocarbon resin having pendant acid groups is generally a copolymer of a first moiety having the empirical formula:

$$\text{+}CF_3\text{—}CX'X''\text{—}$$

and a second moiety having the empirical formula:

$$\text{+}CF_2\text{—}CXY\text{+}$$

X' may be —F, —CL, —H or $CF_3$. Preferably X' is either $—CF_3$ or F. X'' may be either —F, —Cl, —H, $—CF_3$, or $\text{+}CF_2\text{+}_{1\ to\ 5}CH_3$. Preferably X'' is perfluorinated as F, $—CF_3$, or $\text{+}CF_2\text{+}_1$ to $5CF_3$. Y may be either —A, —ϕ—A, $\text{+}CF_2\text{+}_{1\ to\ 10}A$, $—O\text{+}CF_2\text{+}_{1\ to\ 10}A$, $\text{+}O—CF_2—CF_2\text{+}_{1\ to\ 10}A$, $\text{+}O—CF_2—CF((CH_2)_{0\ to\ 10}F)\text{+}A$, $\text{+}O—CF_2—CF_2\text{+}_{1\ to\ 10}\text{+}O—CF_2—CF((CF_2)_{0\ to\ 10}F)\text{+}A$, $—O—OC_2\text{+}CF—O—CF((CF_2)_{0\ to\ 10}F)\text{+}_{1\ to\ 10}\text{+}CF_2\text{+}_{0\ to\ 10}\text{+}O—CF_2—CF((CF_2)_{0\ to\ 10}F)\text{+}A$, or $—CF(\text{+}CF_2\text{+}_{1\ to\ 10}F)\text{+}CF_2—O\text{+}CF(—CF_2)_{0\ to\ 10}F\text{+}CF_2—O\text{+}_{1\ to\ 3}A$, where A is the acid group and ϕ is an aryl group. A may be —COOH, —CN, —COF, $—COO(C_{1\ to\ 10}alkyl)$, —COOM where M is an alkali metal or quaternary amine, $'CON(C_{1\ to\ 10}alkyl)_2$, $—CONH_2$, $—SO_3H$, $(SO_3NH)$ Q where Q is H, $NH_4$, an alkali metal or an alkaline earth metal and m is the valence of Q, or $(SO_3)$ Me where Me is a cation, preferably an alkali metal, and n is the valence of Me.

According to a still further exemplification of this invention, the porous matrix can be fabricated or formed of a fluorinated hydrocarbon resin having pendant acid groups. In this way, the hydrophilic character of the acid groups can be advantageously used.

The diaphragm herein contemplated, with a porous matrix and a contained volume of hydrous oxides of zirconium and magnesium, is prepared by contacting and preferably saturating the porous matrix with zirconium and magnesium compounds and converting the zirconium and magnesium compounds to the hydrous oxides. According to a preferred exemplification, the oxide gel, that is, the hydrous oxides of zirconium and magnesium, is formed in the matrix by codepositing the precursor compounds. This is accomplished by forming a solution of the precursor compounds, for example, zirconium oxychloride and magnesium chloride, in water. The solution preferably contains up to its solubility limit of zirconium oxychloride, that is, up to about 360 grams per liter of the zirconium oxychloride, and the desired amount of magnesium chloride.

The aqueous solution typically contains from about 4 to about 50 mole percent magnesium, basis total moles of magnesium and zirconium. According to a preferred exemplification, the magnesium is present in the solution as magnesium chloride while the zirconium is present in the solution as zirconium oxychloride. Preferably the solution contains from about 300 to about 0 grams per liter of zirconium oxychloride and from about 20 to about 80 grams per liter of magnesium chloride whereby to provide a mole ratio of about 0.04 moles of magnesium to about 0.5 moles of magnesium to total magnesium and zirconium in the solution.

The porous matrix is saturated with the solution after which the mat is contacted with a base. Preferably the base is a gas, for example, ammonia or anhydrous ammonia, although a liquid such as ammonium hydroxide may be used. The base converts the zirconium oxychloride and magnesium chloride to the hydrous oxides of zirconium and magnesium producing ammonium chloride as a by-product.

As herein contemplated there is provided a fast, one cycle method of depositing the zirconium, or zirconium and magnesium gels. The porous matrix, as described above, is inserted in a container, dividing the container into two compartments, which compartments are separated by the porous matrix. The matrix is preferably vertically disposed.

The porous matrix may be deposited on, laminated on, or resting upon a pervious support. Such supports may be a perforated plate, a perforated sheet, metal mesh, expanded metal mesh, or the like.

The liquid composition of the zirconium oxychloride, or of the zirconium oxychloride and magnesium chloride is then added to one side of the divided container, e.g., the side facing the porous matrix and separated from the pervious support by the porous matrix. This is to enable the porous matrix to withstand the pressures imposed thereon.

A vacuum is then drawn on both surfaces of the porous matrix. The vacuum is at least about 500 millimeters of mercury and preferably about 600 to 700 millimeters of mercury, whereby to draw air from inside the porous matrix.

The vacuum is maintained for at least about two minutes, and preferably for from about two to about five minutes. Thereafter the vacuum is released at a rate not faster than about 100 millimeters of mercury per second, and preferably about 50 to about 100 millimeters of mercury per second. Releasing the vacuum draws the liquid composition into the porous matrix.

The vacuum may be drawn and released several times, e.g., up to four, five or six times, whereby to thoroughly wet the interior pores and volumes of of the porous matrix.

In this way at least about 50 grams of $ZrO_2$ per square foot of porous matrix, i.e., at least about 0.1 gram of $ZrO_2$ per cubic centimeter, and preferably 0.1 to 1.0 gram per cubic centimeter of $ZrO_2$ is deposited in the porous matrix.

Thereafter both sides of the porous matrix are contacted with an ammonium compound, preferably gaseous $NH_3$, concurrently with the removal of the zirconium solution from the container, whereby to hydrolyze the deposit. The rate of the withdrawal of the solution, i.e., the rate at which the solution or composition is withdrawn from the container, is about 0.1 to about 1.0 inch per minute, and preferably about 0.2 to about 0.5 inch per minute. Faster rates result in gel loss from the matrix before hydrolysis. Slower rates result in excessive hydrolysis external of the matrix. Preferably about one to 10 grams of ammonium compound, calculated as $NH_3$, is drawn through the porous matrix per gram of $ZrO_2$ and MgO. The initial feed rate of ammonia is from about two to 15 grams per square foot per minute, for about 15 minutes to 4 hours, followed by an ammonia feed rate of about 0.5 to 5 grams per square foot per minute, until about 0.5 to 2.5 kilograms of $NH_3$ per square foot of porous matrix, is drawn through the matrix.

The diaphragm herein contemplated has a porous hydrophobic fluorocarbon matrix, it preferably has an intermediate layer of a film of a hydrophilic fluorocarbon resin, and an outer layer of hydrous oxide of zirconium, or zirconium and magnesium, preferably substantially filling the remaining void volume of the matrix. As herein contemplated, it is prepared by first depositing the hydrophilic fluorocarbon resin in the porous fluorocarbon matrix and thereafter depositing the hydrous oxide in the fluorocarbon matrix.

According to the method herein contemplated, the porous fluorocarbon matrix is coated and preferably saturated with a solution containing the hydrophilic fluorocarbon resin and then the solvent is removed. The resin-treated fluorocarbon matrix may be dried further by passing air through it. Generally the amount of perfluorinated resin deposited in the matrix is from about 0.1 to about 20 weight percent, and preferably from about 0.2 to about 15 weight percent, basis weight of the porous fluorocarbon matrix.

According to one exemplification of the method of this invention, the resin may be deposited by providing a solution of the fluorocarbon resin in an organic solvent such as alcohol or in a miscible system of alcohol and water, thoroughly wetting the mat with the solution, and thereafter evaporating the solvent. Suitable organic solvents include alcohols such as methanol, ethanol, and glycols, triols, ketones, as well as organo phosphorous and organo nitrogen compounds.

After hydrolysis and formation of the ammonium chloride, the ammonium chloride may be left in the porous matrix, for example, to be leached out by the electrolyte. However, according to the method herein contemplated, the ammonium chloride is leached out.

The following examples are illustrative.

EXAMPLE I

A polytetrafluoroethylene felt sheet was impregnated with a copolymer of a perfluorocarbon and a perfluorocarbon ether sulfonic acid, vacuum impregnated with a liquid composition of $ZrO_2$ and MgO, hydrolyzed with $NH_3$, leached with water, and utilized as the diaphragm in a laboratory chlor-alkali cell.

The polytetrafluoroethylene felt had a fiber density of 2.16 grams per cubic centimeter, a thickness of 0.141 inch (3.6 millimeters), a density of 0.559 grams per cubic centimeter, and a void volume of 74.1 percent. The felt was cut to a size of 6.5 inches by 8.5 inches (16.4 centimeters by 21.5 centimeters).

The felt was then treated with a solution of Du Pont NAFION 601 in ethanol. The solution contained 0.562 weight percent solids, and the solids had an equivalent weight of 859.5 grams per equivalent. The treatment of the felt with the perfluorocarbon-perfluorocarbon ether sulfonic acid resin was accomplished by horizontally disposing the felt on a glass plate, and saturating the felt with the solution of the resin. The saturated felt was then allowed to remain in air at about 20 degrees centigrade for about 16 hours to evaporate the ethanol solvent. The partially-dried felt was then heated in air at 90 to 100 degrees centigrade for one hour, soaked in water at 60 degrees centigrade, allowed to remain in air at about 20 degrees centigrade for 16 hours.

The felt mat was then treated with a liquid composition of zirconium oxychloride and magnesium, e.g., a gel solution. The gel solution was prepared by mixing 809.4 milliliters of a zirconium oxychloride solution with 98.6 milliliters of a magnesium solution and 92.0 milliliters of water.

The zirconium oxychloride solution contained 19.79 weight percent $ZrO_2$, and $HFO_2$, with one part $HFO_2$ per 50 parts $ZrO_2$, 10.55 weight HCl and the balance water. The solution had a specific gravity of 1.35.

The magnesium solution contained 1.67 parts by weight $MgCl_2 \cdot 6H_2O$, and one part by weight water. The solution had a density of 1.27 grams per cubic centimeter.

The combined solution contained 16.43 weight percent Zr, calculated as $ZrO_2$; 1.18 weight percent Mg, calculated as MgO; 8.80 weight percent HCl; and balance water.

The felt was inserted vertically in a tank, dividing the tank into two compartments. Gel solution was fed to one side of the tank, while the tank was vented to the air. Thereafter a vacuum of 640 millimeters of mercury was drawn across the system, maintained for three minutes, and released at the rate of about 100 millimeters of mercury per second. This was repeated two times, for a total of three replications. Five hundred and twenty millimeters of gel solution were absorbed per square foot of porous felt.

Thereafter the mat was hydrolyzed with ammonia. Gaseous ammonia was pumped into the tank on both sides of the mat as the gel solution was pumped out. The ammonia feed during this stage was 7 grams of ammonia per square foot of felt per minute. Thereafter the ammonia feed rate was reduced to 2 grams of ammonia per square foot of felt per minute for 4 hours.

After hydrolysis, the porous felt matrix was washed with water to remove the $NH_4Cl$.

The porous felt matrix weighed 583 grams per square foot, for an added weight of 380 grams per square foot of the zirconia-magnesia.

The zirconia-magnesia treated porous felt matrix was then tested in a laboratory diaphragm cell. The cell had a ruthenium dioxide-titanium dioxide coated titanium mesh anode, spaced 0.25 inch from a perforated steel plate cathode.

After 18 days of electrolysis the cell voltage was between 3.24 and 3.27 volts, the anolyte head was 21.75 to 23.25 inches, the caustic concentration was 121.6 to 123.0 grams per liter, the percent decomposition was approximately 50.3 percent, and the cathode current efficiency was between 96.2 percent and 96.5 percent.

EXAMPLE II

A polytetrafluoroethylene felt sheet was impregnated with a copolymer of a perfluorocarbon and a perfluorocarbon ether sulfonic acid, vacuum impregnated with a liquid composition of $ZrO_2$ and MgO, hydrolyzed with $NH_3$, leached with water, and utilized as the diaphragm in a laboratory chlor-alkali cell.

The polytetrafluoroethylene felt had a fiber density of 2.16 grams per cubic centimeter, a thickness of 0.141 inch (3.6 millimeters), a density of 0.521 grams per cubic centimeter, and a void volume of 75.9 percent. The felt was cut to a size of 6.5 inches by 8.5 inches (16.4 centimeters by 21.5 centimeters).

The felt was then treated with a solution of Du Pont NAFION 601 in ethanol. The solution contained 0.562 weight percent solids, and the solids had an equivalent weight of 859.5 grams per equivalent. The treatment of the felt with the perfluorocarbon-perfluorocarbon ether sulfonic acid resin was accomplished by horizontally disposing the felt on a glass plate, and saturating the felt with the solution of the resin. The saturated felt was then allowed to remain in air at about 20 degrees centigrade for about 16 hours to evaporate the ethanol solvent. The partially-dried felt was then heated in air at 90 to 100 degrees centigrade for one hour, soaked in water at 60 degrees centigrade, allowed to remain in air at about 20 degrees centigrade for 16 hours.

The felt mat was then treated with a liquid composition of zirconium oxychloride and magnesium, e.g., a gel solution. The gel solution was prepared by mixing 809.4 milliliters of a zirconium oxychloride solution with 98.6 milliliters of a magnesium solution and 92.0 milliliters of water.

The zirconium oxychloride solution contained 19.79 weight percent $ZrO_2$, and $HFO_2$, with one part $HFO_2$ per 50 parts $ZrO_2$, 10.55 weight percent HCl and balance water. The solution had a specific gravity of 1.35.

The magnesium solution contained 1.67 parts by weight $MgCl_2 \cdot 6H_2O$, and one part by weight water. The solution had a density of 1.27 grams per cubic centimeter.

The combined solution contained 16.43 weight percent Zr; calculated as $ZrO_2$; 1.18 weight percent Mg, calculated as $MgO_3$; 8.80 weight percent HCl; and balance water.

The felt was inserted vertically in a tank, dividing the tank into two compartments. Gel solution was fed to one side of the tank, while the tank was vented to the air. Thereafter a vacuum of 640 millimeters of mercury was drawn across the system, maintained for 3 minutes, and released at the rate of about 100 millimeters of mercury per second. This was repeated two times, for a total of three replications. Five hundred and twenty milliliters of gel solution were absorbed per square foot of porous felt.

Thereafter the mat was hydrolyzed with ammonia. Gaseous ammonia was pumped into the tank on both sides of the mat as the gel solution was pumped out. The ammonia feed during this stage was 7 grams of ammonia per square foot of felt per minute. Thereafter the ammonia feed rate was reduced to 2 grams of ammonia per square foot of felt per minute for 4 hours.

After hydrolysis, the porous felt matrix was washed with water to remove the $NH_4Cl$.

The porous felt matrix weighed 573.4 grams per square foot, for an added weight of 390.4 grams per square foot of the zirconia-magnesia.

The zirconia-magnesia treated porous felt mixture was then tested in a laboratory diaphragm cell. The cell has a ruthenium dioxide-titanium dioxide coated titanium mesh anode, spaced 0.25 inch from a perforated steel plate cathode.

After 11 days of electrolysis the cell voltage was between 3.20 and 3.34 volts, the anolyte head was 16 to 19.25 inches, the caustic concentration was 122.0 to 124.7 grams per liter, the percent decomposition was approximately 50.4 percent and the cathode current efficiency was between 96.9 percent and 97.2 percent.

While the invention has been described with reference to specific exemplifications and embodiments thereof, the invention is not limited except as in the claims appended hereto.

I claim:

1. In a method of preparing a diaphragm by contacting a porous matrix with zirconium oxychloride, and thereafter contacting the zirconium oxychloride containing porous matrix with an ammonium compound whereby to hydrolyze the zirconium oxychloride to form a substantially insoluble hydrous oxide of zirconium, the improvement comprising:

a. inserting the porous matrix in a container containing an aqueous liquid composition of the zirconium oxychloride on only one surface of said porous matrix;

b. drawing a vacuum on the surface of said porous matrix opposite the surface contacting the aqueous liquid composition and thereafter releasing the vacuum, whereby to evacuate the porous matrix and draw the aqueous liquid composition into the porous matrix; and c. thereafter allowing an ammonium compound to penetrate the porous matrix to hydrolyze the zirconium oxychloride.

2. The method of claim 1 comprising leaching the porous matrix with water after hydrolysis.

3. The method of claim 1 comprising drawing a vacuum of at least about 500 millimeters of mercury across the matrix.

4. The method of claim 3 comprising maintaining the vacuum across the porous matrix for at least about two minutes.

5. The method of claim 4 comprising releasing the vacuum at a rate of less than 100 millimeters of mercury per second.

6. The method of claim 3 comprising drawing and retaining the vacuum at least twice in succession.

7. The method of claim 1 comprising depositing at least 50 grams of zirconium, calculated as $ZrO_2$, per square foot, on the porous matrix.

8. The method of claim 1 comprising passing about 1 to 10 grams of the ammonium compound, calculated as $NH_3$, through the porous matrix, per gram of oxides.

9. The method of claim 1 comprising passing the ammonium compound through the porous matrix for about 2 to 6 hours.

10. The method of claim 1 comprising passing about 0.5 to about 25 kilograms of ammonia compound, calculated as $NH_3$, through the porous matrix, per square foot.

11. The method of claim 1 wherein the porous matrix is formed of a material chosen from the group consisting of asbestos, halocarbon fibers, porous halocarbon sheets, and ceramic fibers.

12. The method of claim 1 wherein the porous matrix has a coating of a hydrophilic resin.

13. The method of claim 1 wherein the aqueous liquid composition of zirconium hydroxide comprises $ZrO_2$, HCl, and water.

14. The method of claim 13 wherein the aqueous liquid composition of zirconium hydroxide comprises MgO.

15. The method of claim 14 wherein the weight ratio of zirconia to total magnesia and zirconia in the porous matrix is from about 0.70 to about 0.995.

16. The method of claim 1 wherein the porous matrix is vertical.

* * * * *